US006736674B2

(12) United States Patent
Korte et al.

(10) Patent No.: US 6,736,674 B2
(45) Date of Patent: May 18, 2004

(54) METHOD AND CONNECTOR FOR COUPLING TO MULTI-CONDUCTOR CABLE

(75) Inventors: Donald R. Korte, Belleair Beach, FL (US); Rip Hanks, Gulf Breeze, FL (US)

(73) Assignee: Centerpin Technology, Inc., Pensacola, FL (US)

( * ) Notice: Subject to any disclaimer, the term of this patent is extended or adjusted under 35 U.S.C. 154(b) by 0 days.

(21) Appl. No.: 10/197,983

(22) Filed: Jul. 17, 2002

(65) Prior Publication Data

US 2003/0060082 A1 Mar. 27, 2003

Related U.S. Application Data

(60) Provisional application No. 60/306,038, filed on Jul. 17, 2001.

(51) Int. Cl.[7] ..... H01R 5/09
(52) U.S. Cl. ..... 439/578; 439/394
(58) Field of Search ..... 439/578, 584, 439/394, 427, 695

(56) References Cited

U.S. PATENT DOCUMENTS

| | | | | | |
|---|---|---|---|---|---|
| 3,744,007 | A | | 7/1973 | Horak | 439/584 |
| 3,977,752 | A | * | 8/1976 | Freitag | 439/411 |
| 4,178,054 | A | | 12/1979 | Laudig | 439/427 |
| 4,270,827 | A | | 6/1981 | Potgieter | 439/584 |
| 4,449,779 | A | * | 5/1984 | Hampshire | 439/578 |
| 4,696,908 | A | | 9/1987 | Gutter et al. | 439/98 |
| 4,759,722 | A | | 7/1988 | Song | 439/394 |
| 5,052,946 | A | | 10/1991 | Homolka | 439/584 |
| 5,066,248 | A | | 11/1991 | Gaver, Jr. et al. | 439/578 |
| 5,181,861 | A | * | 1/1993 | Gaver et al. | 439/578 |
| 5,246,384 | A | * | 9/1993 | Sato | 439/585 |
| 5,485,355 | A | | 1/1996 | Voskoboinik et al. | 362/84 |
| 5,573,423 | A | | 11/1996 | Lin et al. | 439/462 |
| 5,573,433 | A | | 11/1996 | Lin et al. | 439/805 |
| 5,607,320 | A | | 3/1997 | Wright | 439/394 |
| 5,704,814 | A | | 1/1998 | McCarthy | 439/695 |
| 5,899,777 | A | | 5/1999 | Liang | 439/805 |
| 5,913,694 | A | * | 6/1999 | Wright | 439/394 |
| 5,931,698 | A | * | 8/1999 | Kodama | 439/578 |
| 5,934,937 | A | | 8/1999 | McCarthy | 439/583 |
| 5,934,943 | A | | 8/1999 | McCarthy | 439/695 |
| RE36,700 | E | | 5/2000 | McCarthy | 439/427 |
| 6,062,897 | A | | 5/2000 | McCarthy | 439/427 |
| 6,071,155 | A | | 6/2000 | Liang | 439/805 |
| 6,123,567 | A | | 9/2000 | McCarthy | 439/427 |
| 6,126,491 | A | | 10/2000 | McCarthy | 439/695 |
| 6,200,162 | B1 | * | 3/2001 | Aoyama et al. | 439/578 |
| 6,244,892 | B1 | | 6/2001 | McCarthy | 439/421 |
| 6,517,379 | B2 | | 2/2003 | Leve | 439/578 |
| 2002/0127911 | A1 | * | 9/2002 | Di Mario | 439/578 |

* cited by examiner

*Primary Examiner*—Michael C. Zarroli
(74) *Attorney, Agent, or Firm*—Piper Rudnick LLP; Jefferson Perkins

(57) ABSTRACT

The subject invention pertains to a method and connector for coupling to a cable having a center conductor surrounded by a layer of material, further surrounded by one or more conductor wires. In a specific embodiment, the subject coupler can be used with a cable for producing light via electroluminensce. The subject connector for coupling to a cable having a center conductor surrounded by a layer of material, further surrounded by at least one outer conductor wire, can comprise a housing having an electrically conductive portion; an electrically conductive pin, wherein at least a portion of the pin is hollow for receiving a center conductor of a cable; and at least one electrically conductive arm connected to the electrically conductive portion of the housing and insulated from the pin, wherein the at least one electrically conductive arm each having an end adaptive to press one or more of at least one outer conductor wire of the cable against the cable such that electrical contact is made between the electrically conductive arm and the one or more of the least one outer conductor wire of the cable.

11 Claims, 10 Drawing Sheets

METHOD AND CONNECTOR FOR COUPLING TO MULTI-CONDUCTOR CABLE

CROSS-REFERENCE TO RELATED APPLICATION(S)

The present application claims priority to U.S. Provisional Patent Application Serial No. 60/306,038, filed Jul. 17, 2001, which is hereby incorporated by reference herein in its entirety, including any figures, tables, or drawings.

BACKGROUND OF INVENTION

The present invention relates to a method and connector for coupling to multi-conductor cable. In specific embodiments, the subject invention pertains to an electrical connector for coupling to a cable having a center conductor surrounded by a layer of material, further surrounded by at least one outer conductor wire. The layer of material surroundng the center conductor can be an insulating layer. This layer of material can incorporate a dielectric layer, electroluminescent (EL) layer, and/or an ITO layer. In a specific embodiment, the subject method and connector is adapted for coupling to a multi-conductor cable having a center conductor surrounded by a layer of material, further surrounded by two outer conductor wires which are embedded in a layer. Additional protective and/or other layers may then surround the layer. Specific examples of cables to which the subject connector may couple to are described in U.S. Pat. No. 5,485,355, which is herein incorporated by reference.

Electroluminescent cable, such as cables described in U.S. Pat. No. 5,485,355, can produce light when a potential difference is applied between the center conductor and the outer conductor wires. Accordingly, it is desired to have a connector and a method for easily coupling the connector to the cable such that an appropriate potential difference can be conveniently applied across the center conductor and the outer conductors via, for example, a coaxial cable.

BRIEF SUMMARY

The subject invention pertains to a method and connector for coupling to a cable having a center conductor surrounded by a layer of material, further surrounded by a layer having one or more outer conductors embedded therein. The layer of material surrounding the center conductor can be an insulating layer. In a specific embodiment, the subject coupler can be used with a cable for producing light via electroluminensce. Examples of electroluminescent cables with which the subject invention can be used are described in U.S. Pat. No. 5,485,355.

The present invention relates to a connector and a method for coupling the same to a cable having a center electrical conductor and an outer electrical conductor. In a specific embodiment, the present invention relates to a connector and to a method for coupling the same to an electroluminescent light cable having a center electrical conductor, an electrical insulating layer, and electroluminescent layer, an outer electrical conductor of a layer of transparent material embedding a spiraled conductive terminal wire, and a transparent outer protective layer such as disclosed in U.S. Pat. No. 5,485,355. The connector and method of the present invention makes an electrical connection at the cable between the central electrical conductor and the spiraled conductive terminal wire so as to apply an electric field across the electroluminescent layer which stimulates the same into luminescence.

The subject connector can be coupled to the cable without the use of solder. As a first step, the cable can be prepared in a manner to allow the subject connector to contact the cable's center conductor with a pin and contact one or more of the cable's outer conductors with one or more clamping arms. Preferably the end of the cable is prepared such that a portion of the cable's center conductor protrudes from the end of the cable and the cable's outer conductors extend out from the cable to make it easier to contact the outer conductors such that the electrical isolation between the cable's center conductor and outer conductors can be maintained.

DETAILED DISCLOSURE OF THE INVENTION

Figure 1:
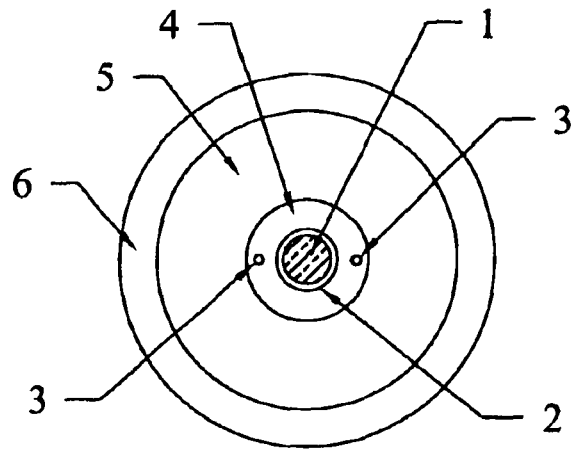
FIG. 1 is a sectional view of a multi-conductor cable to which a connector in accordance with the present invention can be coupled.

The subject invention pertains to a method and connector for coupling to a cable having a center conductor surrounded by a layer of material, further surrounded by at least one outer conductor wire. The layer of material surrounding the center conductor can be an insulating layer. This layer of material can incorporate a dielectric layer, ElectroLuminescent (EL) layer, and/or an ITO layer. This layer of material can further be surrounded by a layer having one or more outer conductor wires embedded therein. The outer conductor wires, embedded in a further layer or not, can have a variety of cross-sectional shapes, such as circular, elliptical, rectangular, and can be positioned around the layer of material surrounding the center conductor in a variety of patterns, such as helically wound around the layer of material. In a specific embodiment, the subject connector can be used with a cable for producing light via electroluminensce. Referring to FIG. 1, the cross section of a specific example of multi-conductor cable 7 is illustrated. The cable incorporates a center copper wire 1, surrounded by an insulating layer 2. The insulating layer 2 is surrounded by a layer of electroluminescent material 4 around which outer conducting terminal wires 3 are spirally wound. A polyvinyl chloride (PVC) layer 5 surrounds the layer 4, and a fluoropolymer layer 6 surrounds the PVC layer 5. When a potential difference is applied between the center copper wire 1 and the outer conducting wires 3, light can be produced in the inner layer 2 and/or layer 4 via electroluminescence.

Figure 2:
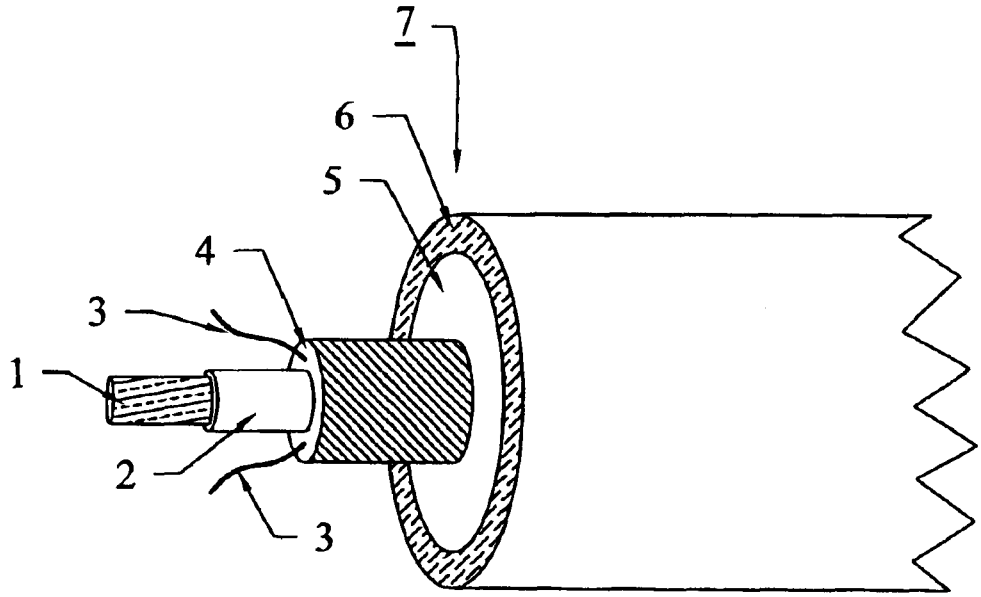
FIG. 2 is a perspective view of the multi-conductor cable of FIG. 1 showing various layers and the outer conductors extending from the cable end.
Figure 3A:
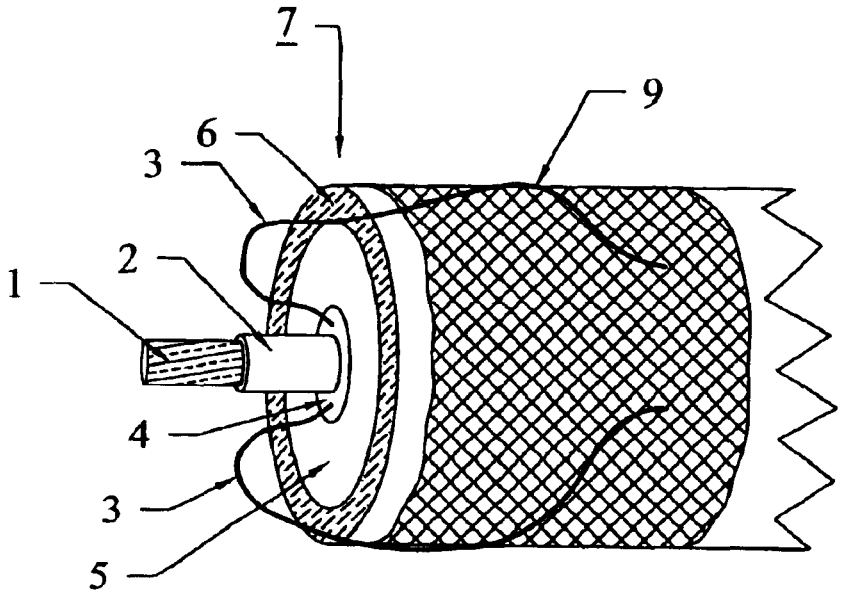
FIGS. 3A and 3B are perspective views of the multi-conductor cable showing the outer conductors attached to the outer insulation and inner layers, respectively, with a conductive medium.
Figure 3B:
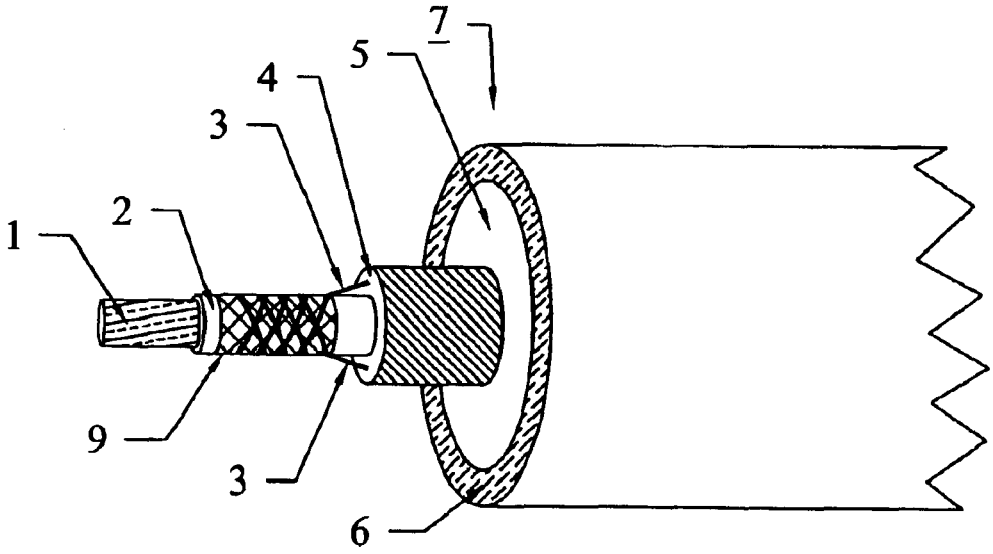
Figure 5:
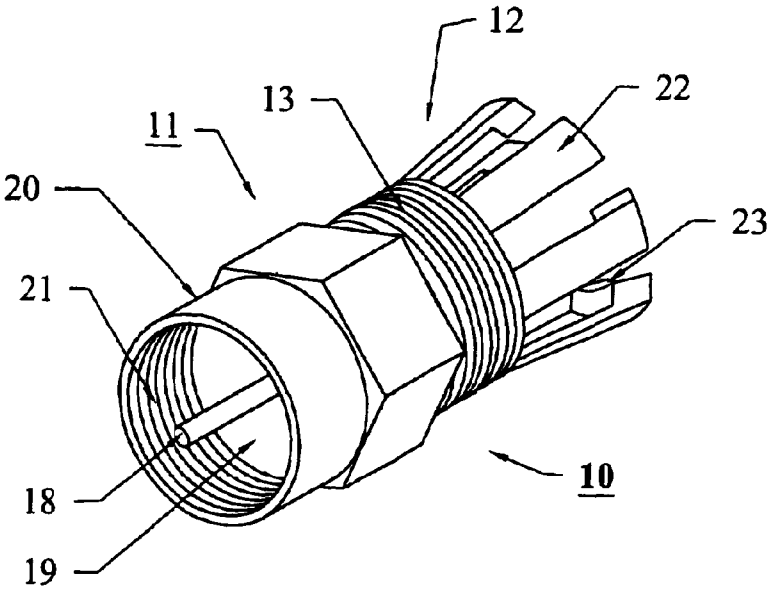
FIG. 5 is an exploded view of the electrical connector of FIG. 4, from the opposite direction.
Figure 4:
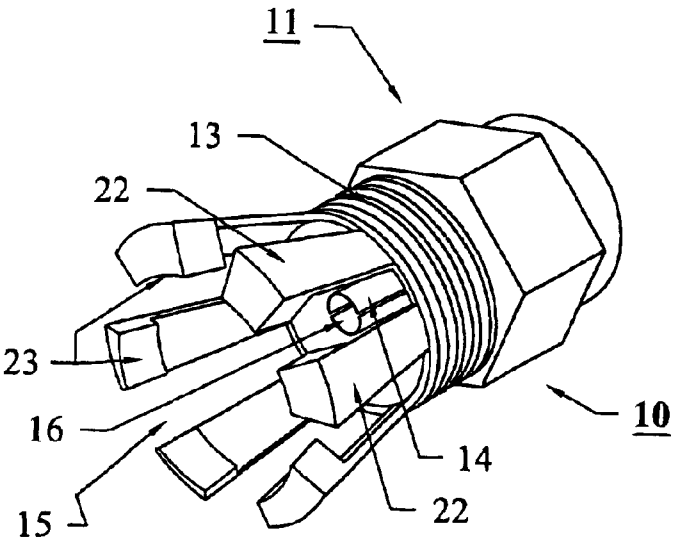
FIG. 4 is an exploded view of an electrical connector in accordance with the present invention.

FIG. 2 illustrates the cable of FIG. 1 after stripping the cable to expose the various layers and the outer conductors. The stripping can be accomplished by a variety of means, including a stripper designed for this type of cable. In a specific embodiment, a first stripping step can expose the two outer conductors 3 and a second stripping step can remove, the inner layer 2 in order to expose the center conductor 1. The subject connector can also be utilized with cables have one outer conductor or more than two outer conductors. The outer conductor wires 3, which are non-rigid for easy manipulation, extend from the LPDE layer 4. Note that the protruding center conductor 1, inner layer 2, outer conductor wires 3, and layer 4 all protrude from the end of cable 7. Other configurations for stripping the end of cable 7 can also be utilized. The subject connector makes electrical contact with center conductor 1 and electrical contact with outer conductor 3 while maintaining electrical isolation between center conductor 1 and outer conductors 3. Preferably, due to the narrow thickness of inner layer 2, the outer conductor wires 3 extend from the LPDE layer 4 to allow electrical contact to be more easily made with outer conductor wires 3. For example, contact can be made by positioning the outer conductors 3 between a conductive medium 9 and the fluoropolymer layer 6 as shown in FIG. 3A, or between a conductive medium 9 and the inner layer 2 as shown in FIG. 3B. In a specific embodiment, as shown in FIG. 3A, the outer conductor wires 3 are positioned between 9 and the fluoropolymer layer 6, wherein the layer 4 is flush with the end of cable 7. Alternatively, the outer conductor 3 can be positioned between a conductive medium 9 and the layer 4, where the layer 4 extends from the end of cable 7 as shown in FIG. 3A. Examples of conductive mediums 9 which can be used for this purpose include copper tape or an electrically conductive sleeve such as a brass sleeve. In a specific embodiment, 3M's copper adhesive tape can be used. Preferably, the adhesive can be conductive. Other conductive materials can be used as well. Alternatively, the subject connector can be used without the utilization of a conductive medium 9 such that direct contact is made between the connector and the outer conductors.

Referring to FIGS. 4–9, an electrical connector 10 in accordance with the subject invention, especially adapted for use with a multi-conductor electrolumidesent cable, is illustrated. Although the connector shown in FIGS. 4–9 terminates as an F-type Connector, the subject connector can also terminate in other type connector terminations, such as BNC or TNC. Connector 10 includes a connector housing 11 having a cylindrical cable attaching portion 12, with external threads 13, defining a first bore 15, and a cylindrical housing portion 20, with internal threads 21, defining a second bore 19. An electrically conductive pin 14 is mounted through an insulation base 17. Insulation base 17 is secured to the inside of housing 11 and electrically isolates pin 14 from housing 11. Preferably, the conductive pin 14 has a hollow prong 16 extending axially into the first bore 15 for receiving the protruding center conductor of the multi-conductor cable. Pin 14 can also have a prong 18 extending axially into the second bore 19 for coupling to, for example, another connector. Pin 14 can be hollow through a portion of, or all of, the housing 11 region. Preferably, the hollow prong 16 is a little shorter than the length of center conductor 1 protruding from the end of cable 7, to minimize the chance of prong 16 contacting outer conductors 3 of the multi-conductor cable when center conductor 1 is inserted into hollow prong 16. Preferably, hollow prong 16 incorporates one or more longitudinal slits extending along its side wall. These slits can allow for expansion of the end of hollow prong 16 upon receipt of the protruding center conductor 1, which may have a larger outer diameter than the inner diameter of the hollow prong 16. Allowing hollow prong 16 to expand upon receipt of center conductor 1 helps to create a strong physical connection.

Electrically conductive arms 22 extend from the cable attaching portion 12 of the housing 11 and terminate at their respective contacts 23. Contacts may be pointed, flat, or of a shape which enhances contact with outer conductors 3. One or more of the arms can be adapted to be moved radially inward toward cable 7 in order to make electrical contact with outer conductors 3. A plurality of arms 22 are contemplated but a single arm can perform the operation of electrically connecting to the outer conductors of cable 7. In addition, arms 22 can act to mechanically secure the subject connector to the end of cable 7. Also, additional arms 22 may be used which do not make electrical contact with outer conductors 3, but whose primary purpose is to mechanically secure the subject connector to the end of cable 7. In a specific embodiment, a portion of housing 11 between one or more pairs of adjacent arm 22 can have a slit, for example reaching up into threads 13, which can allow visual confirmation of the entry of center conductor 1 into hollow prong 16.

Figure 6:
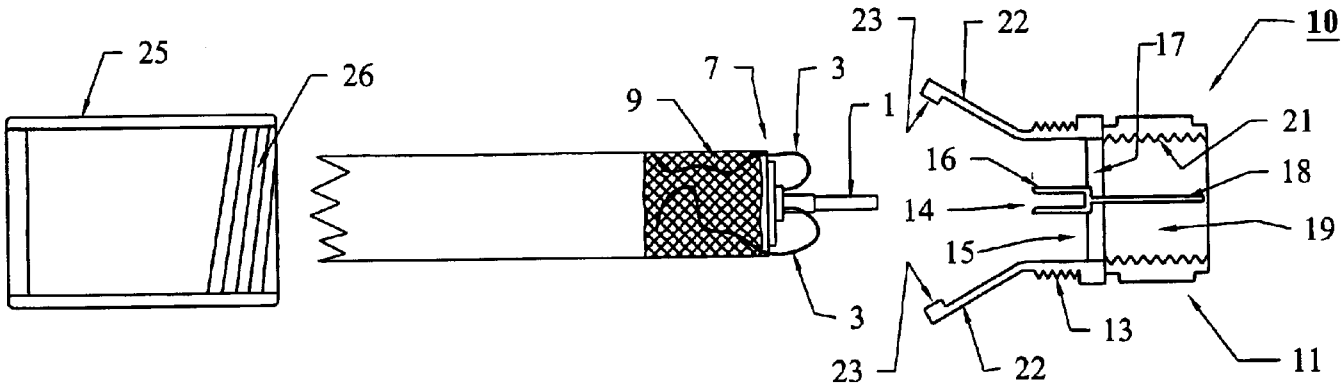
FIG. 6 is a sectional exploded view of the electrical connector of FIGS. 4 and 5 and a portion of a multi-conductor cable in accordance with the present invention.
Figure 7:
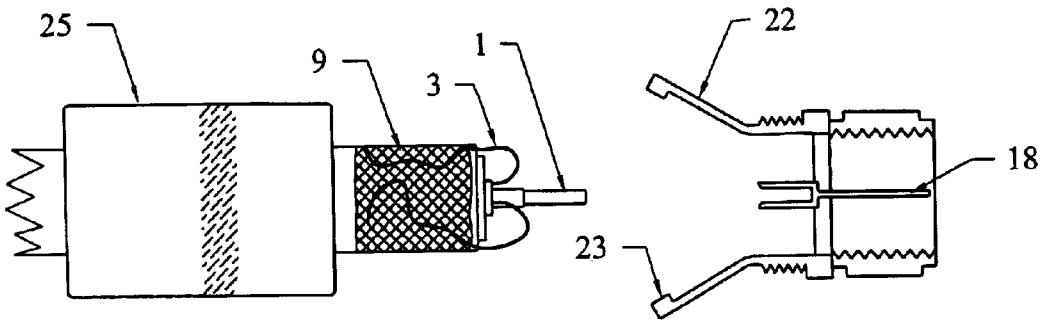
FIG. 7 is a sectional view of the electrical connector of FIG. 6 with a multi-conductor cable partially connected thereto.
Figure 8:
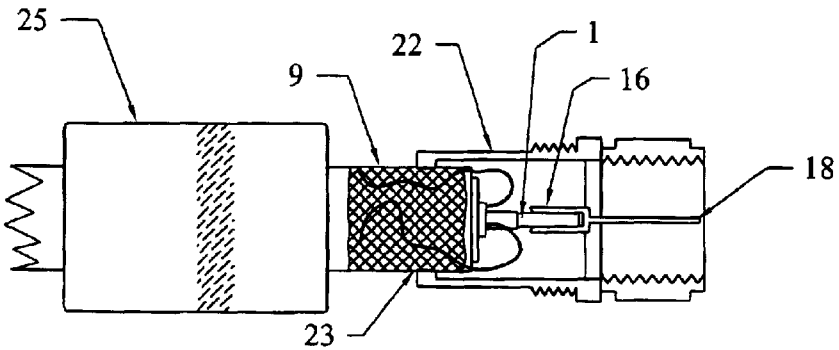
FIG. 8 is a sectional view of the electrical connector of FIG. 7 connected to a multi-conductor cable.

In a specific embodiment, the multi-conductor cable 7, prepared as shown in FIG. 3A, is inserted through thread-on cap 25 with internal threads 26. Cable 7 is then passed between arms 22 which are spread to allow cable 7 to pass during insertion into the connector 10, as illustrated in FIG. 6. As cable 7 is pushed into first bore 15, protruding center conductor 1 makes contact with and slides inside hollow prong 16 of center pin 14, as shown in FIG. 7. Referring to FIG. 8, after the protruding center conductor 1 is correctly positioned with the hollow prong 16 of center pin 14, the arms 22 are pushed radially inward so that contacts 23 contact the outer conductors or other conductive medium 9 in electrical contact with outer conductors 3. Electrical contact between contacts 23 and outer conductors 3 or conducting medium 9 effect an electrical connection between the housing 11 and the outer conductor wires 3. Preferably, the contacts 23 clamp the middle of conductive medium 9. These contacts 23 can be pointed so to penetrate the conductive medium 9 or, alternatively, may have rounded or flat surfaces. Various configurations can be used, such as n-shaped polygons or a knurled surface for added friction.

Figure 9:
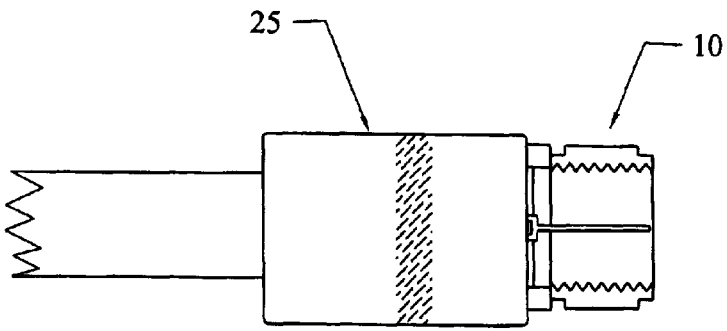
FIG. 9 is a sectional view of the electrical connector of FIG. 8 with a thread-on cap secured to the housing.

Preferably, after protruding center conductor 1 has been seated into hollow prong 16 of center pin 14, a portion of protruding center conductor 1 remains outside the hollow prong 16, as shown in FIG. 8. This can reduce the risk of hollow prong 16 penetrating the cable 7 and electrically contacting outer conductor wires 3. Finally, after pushing arms 22 into place, cap 25 can be slid over arms 22 and threaded onto external threads 13 of the cable attaching portion 12 so to secure cap 25 to housing 11, as shown in FIG. 9. Cap 25 can act to hold contacts 23 firmly against outer conductors 3 or conducting medium 9 in order to ensure electrical contact is maintained. In the embodiment shown in FIGS. 4–9, cap 25 is a thread-on cap. Other attaching mechanisms for cap 25 can be utilized depending on the application, for example clip-on or groove and lock connections. If desired, o-rings, or other equivalent means, can be incorporated with the cap 25 to protect the connection from moisture and other environmental conditions and/or to enhance the performance of the cap.

Figure 10B:
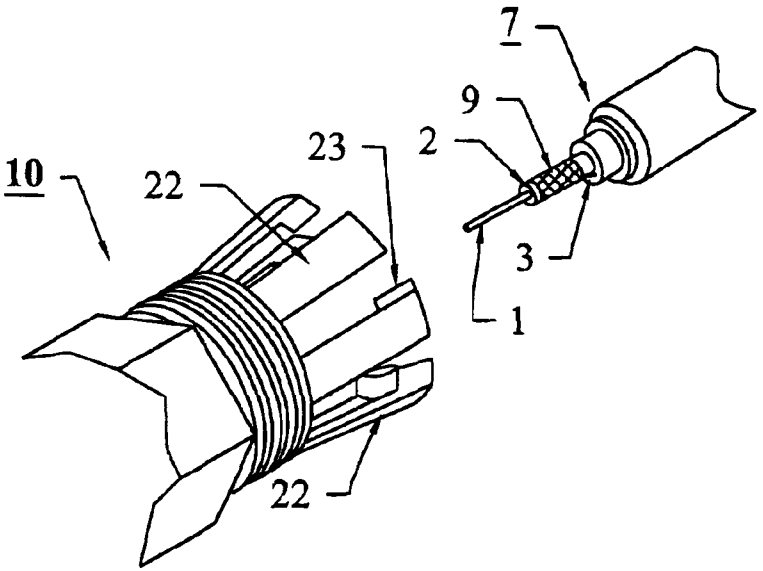
FIGS. 10A and 10B are perspective views of the electrical connector of FIG. 8 prior to connection with the multi-conductor cable configurations of FIGS. 3A and 3B, respectively.
Figure 10A:
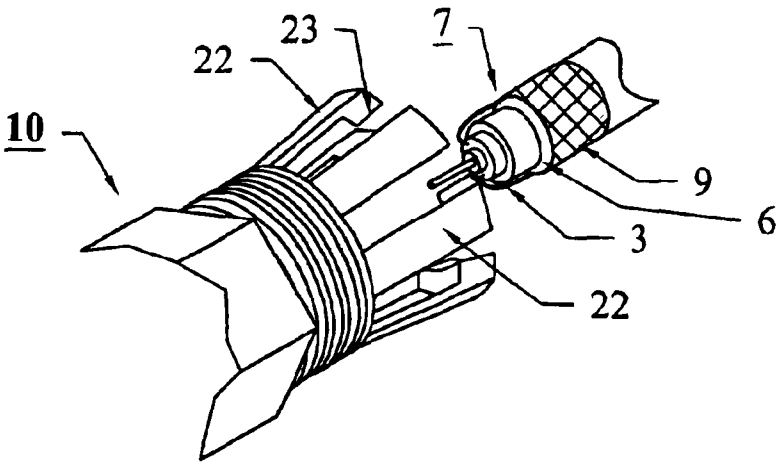

FIGS. 10A and 10B show a close-up view of the subject connector and the stripped end of cable 7 illustrated in FIGS. 3A and 3B, respectively, just prior to attachment of cable 7 to connector 10. If desired, protruding center conductor 1 can be longer in the configuration shown in FIG. 3B than in the configuration shown in FIG. 3A so that the contacts 23 do not overshoot the conductive medium 9 after protruding center conductor 1 is seated within hollow prong 16. With respect to the embodiment shown in FIGS. 3B and 10B, several of arms 22 can extend further out such that contacts 23 contact outer layer 6 of cable 7 for additional mechanical support, rather than conducting medium 9. In a specific embodiment, the subject connector can have six arms 22 and can be designed to contact a conducting medium 9 wrapped around outer conducting wires 3 against inner layer 2, as in FIG. 3B. Three arms 22 can be sized such that contacts 23 electrically contact conducting medium 9 and three arms, alternating with the first three arms, can be sized such that contacts 23 grip outer layer 6 for additional mechanical support.

Figure 11B:
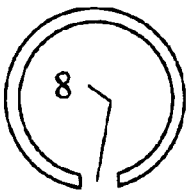
FIG. 11B shows an end cross-sectional view of the hollow portion of the pin shown in FIG. 11A.
Figure 12B:
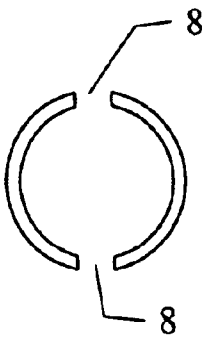
FIG. 12B shows an end cross-sectional view of the hollow portion of the pin shown in FIG. 12A.
Figure 11A:
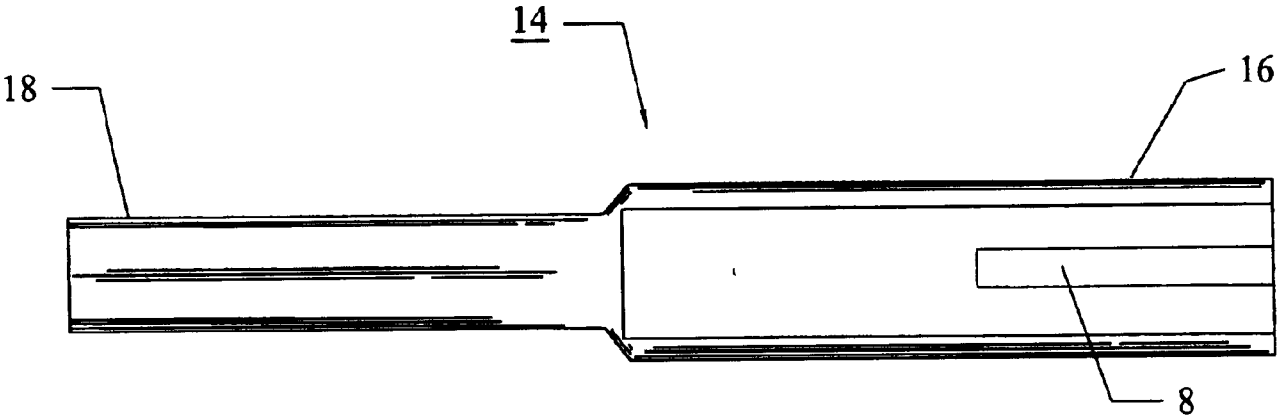
FIG. 11A illustrates a side view of a conductive pin in accordance with the subject invention, incorporating a hollow portion having a single slit.
Figure 12A:
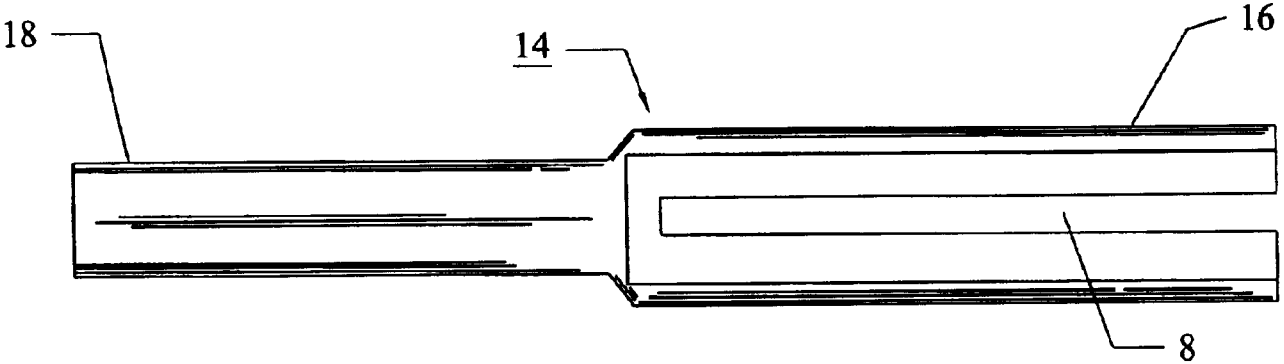
FIG. 12A illustrates a side view of a conductive pin in accordance with the subject invention, incorporating a hollow portion having two slits.

Referring to FIGS. 11A, 11B, 12A, and 12B, specific embodiments of a pin which can be utilized with respect to the electrical connectors of the subject invention are shown. For example, either pin shown in FIGS. 11A or 12A, or variations thereof, can be incorporated with the electrical connector shown in FIGS. 4–9. Both FIGS. 11A and 12A show side views of pins having a hollow portion on one end for receiving an electrical conductor and a solid portion for connecting with an external apparatus or other coaxial cable on the other end. Other pin embodiments are possible which, for example, have a solid portion at each end of the pin or have a hollow portion at each end of the pin. Preferably, the hollow portion of each pin can have one or more slits. The number, length, and widths of the slits can vary depending on the application. FIG. 11A shows a slit which extends about half the length of the hollow portion of the pin, while FIG. 12A shows two slits which extend essentially the entire length of the hollow portion of the pin. FIGS. 11B and 12B show end views of the hollow portions of the pins shown in FIGS. 11A and 12A, respectively. These slits can allow the hollow portion to expand to just the right size to receive an electrical conductor such that a good electrical contact can be made. The ends of the hollow pin can be beveled to ease the insertion of the center conductor.

Figure 13:
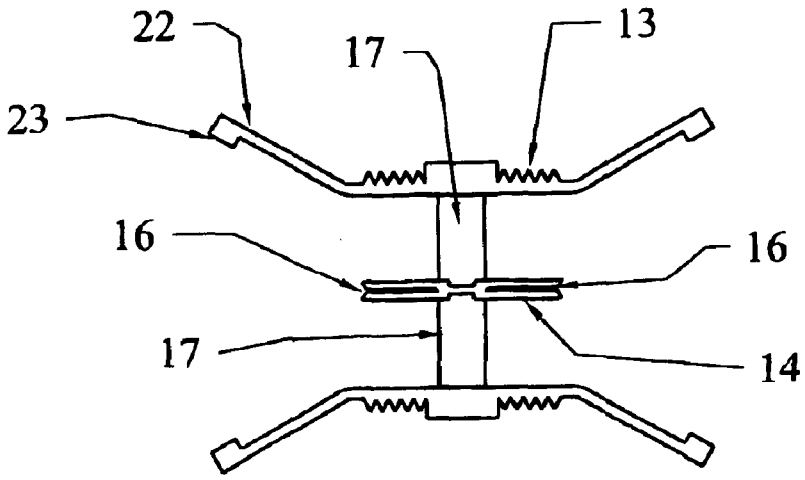
FIG. 13 shows a cross-sectional view of an electrical connector in accordance with the present invention which couples two multi-conductor cables.
Figure 14:
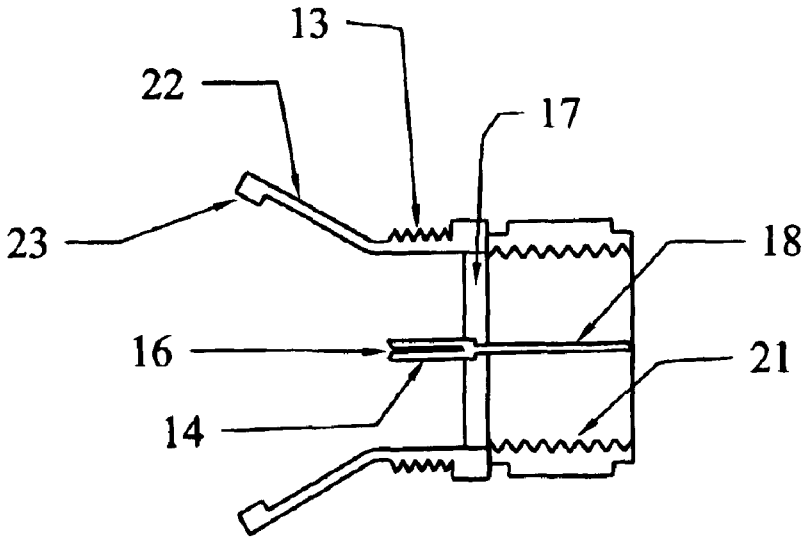
FIG. 14 shows a cross-sectional view of an electrical connector in accordance with the present invention which couples a multi-conductor cable to a standard coaxial cable.

Once electrical contact is made between center pin 14 and center conductor 1, and between housing 11 and outer conductors 3, as shown in FIG. 14 a variety of designs can be used to enable the connection of connector 10 to other connectors or devices using prong 18. For example, a symmetric design can be utilized to connect a second cable 7 identical to cable 7 to form a splice coupler. This design is shown in FIG. 13, which illustrates the symmetric design with equivalent components on either side of the insulation base 17. Alternatively, a design in which prong 18 is solid and penetrates a standard female coaxial cable connector can be used. For example, a BNC, TNC, or other format can be utilized as the other end of the subject splice connector.

Figure 15:
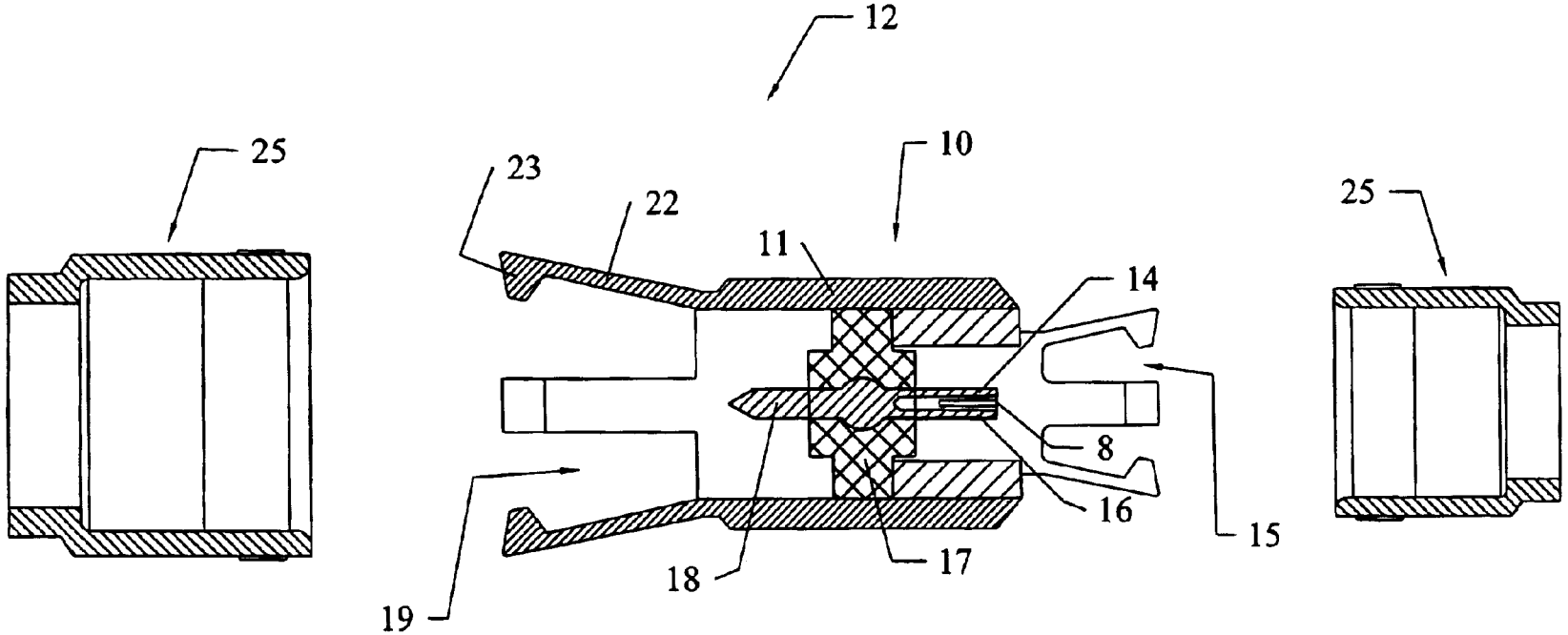
FIG. 15 shows a cross-sectional view of a splice connector in accordance with the present invention which couples a multi-conductor cable to a RG-8x coaxial cable.
Figure 16A:
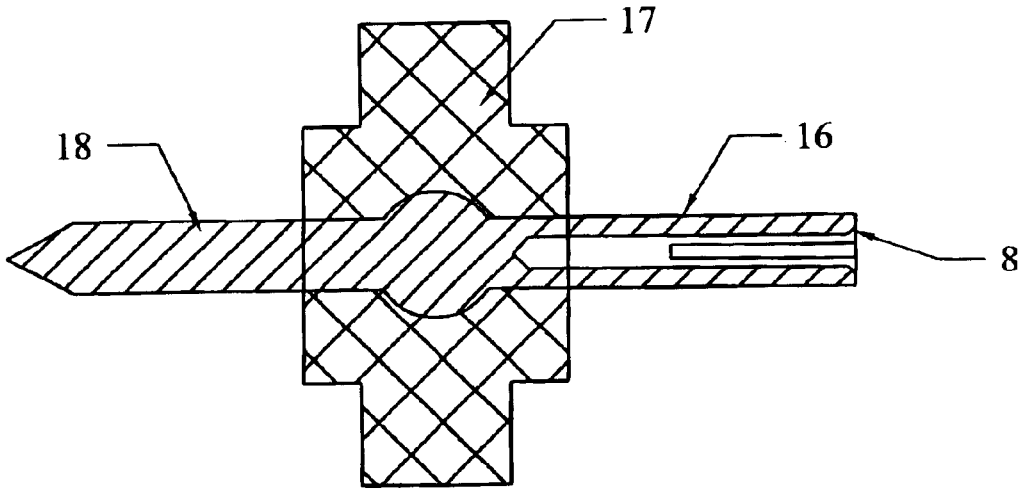
FIGS. 16A and 16B show a pin which can be used with the connector shown in FIG. 15, with and without an insulation base, respectively.
Figure 16B:
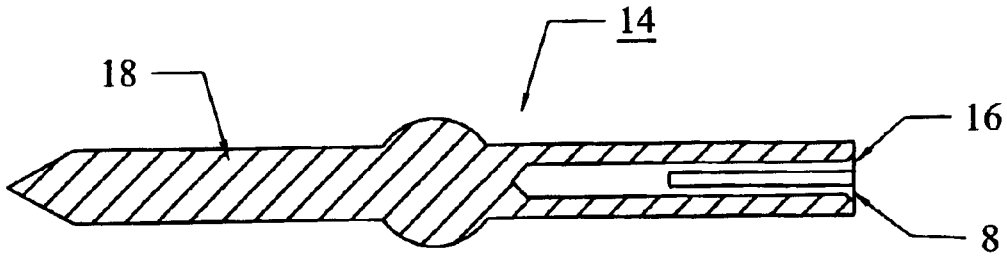

Referring to FIG. 15, prong 18 can also extend into second bore 19 to receive the end of a coaxial cable wherein the end of the coaxial cable is pushed into second bore 19 and prong 18 contacts the center conductor of the coaxial cable and arms 22 can be pushed toward the coaxial cable so as to penetrate the outer insulation and contact the outer conductor of the coaxial cable. The cap 25 can then be threaded onto the housing 11 to hold arms 22 in place. In a specific embodiment, RG-8x coaxial cable can be coupled to the multi-conductor cable and can provide 300 Vrms to power the multi-conductor cable. FIGS. 16A and 16B show an embodiment of the conductive pin 14 used with the connector of FIG. 15, wherein the prong 18 contacting the center conductor of the coaxial cable is solid and the prong 16 is hollow with slits 8 to accept the center conductor of a light pipe. The prong 16 can be hollow, with or without slits, on one or both ends.

It is understood that the electroluminescent light cable disclosed in U.S. Pat. No. 5,485,355 may be polychromatic and of a construction including a center conductor and a plurality of conducting terminal wires for a corresponding plurality of different color designations. Accordingly, the connector of the invention may have a plurality of separate conductive arms corresponding to the plurality of conducting terminal wires insulated from one another for separately engaging the each conducting terminal wire on the surface of the outer insulating cover, thereby to separately control the voltages on the wires of different color designations and to control the color of the light emitted from the electroluminescent light cable.

All patents, patent applications, provisional applications, and publications referred to or cited herein are incorporated by reference in their entirety to the extent they are not inconsistent with the explicit teachings of this specification.

The present invention should not be construed as limited to the forms shown which are to be considered illustrative rather than restrictive.

What is claimed is:

1. A connector for coupling to a cable having a center conductor, a surrounding electrical conductor with an exposed conductive terminal wire, the surrounding electrical conductor being insulated from the center conductor, and an outer insulating cover, the connector comprising:

a housing having an electrically conductive portion and an insulating portion;

an electrically conductive pin in said housing and mounted to one of said conductive portion and said insulating portion;

an electrically conductive arm mounted on said housing to the other one of said conductive portion and said insulating portion; and means for pressing said electrically conductive arm against the surface of the outer insulating cover, whereby when the exposed conductive terminal wire is disposed on the surface of the outer insulating cover of the cable, electrical connection is made between said pin and the center conductor and electrical connection is made between said conductive arm and the terminal wire.

2. The connector set forth in claim 1 wherein said cable has a conductive stratum on the surface of the outer insulating cover to which the terminal wire is connected and against which the electrically conductive arm is pressed.

3. The connector set forth in claim 1, wherein the electrically conductive pin comprises a hollow portion for engaging the center conductor of a cable.

4. A connector-cable connection, comprising:

a cable including:

a center conductor, surrounding electrical conductor with an exposed conductive terminal wire, the surrounding electrical conductor being insulated from the center conductor, and an outer insulating cover with a conductive stratum on its outer surface to which the conductive terminal wire is connected, and a connector including:

a housing having an electrically conductive portion and an insulating portion, an electrically conductive pin in said housing and mounted to one of said conductive portion and said insulating portion, an electrically conductive arm mounted on said housing to the other one of said conductive portion and said insulating portion, and means for pressing said electrically conductive arm against the conductive stratum on the surface of the outer insulating cover, whereby electrical connection is made between said pin and the center conductor and electrical connection is made between said conductive arm and the terminal wire.

5. The connector in combination with a cable set forth in claim 4, wherein the electrically conductive pin comprises a hollow portion for engaging the center conductor of a cable.

6. A connector for coupling to a cable having a center conductor, a layer of material surrounding the center conductor, and at least one surrounding conductor wire surrounding the center conductor and having an exposed terminal segment, comprising:

a housing having an electrically conductive portion;

an electrically conductive pin for contacting the center conductor; and at least one electrically conductive arm connected to the electrically conductive portion of the housing and insulated from the pin;

wherein each of the at least one electrically conductive arm having an end adapted to press against the cable such that electrical contact is made between the electrically conductive arm and the terminal segments of one or more of the at least one surrounding conductor wire of the cable.

7. The connector according to claim 6, wherein at least a portion of the pin is hollow for receiving the center conductor.

8. The connector according to claim 6, further comprising:

an insulating base secured to the housing, wherein the pin is mounted in the insulated base such the insulating base insulates the pin from the electrically conductive portion of the housing.

9. The connector according to claim 8, wherein the cable is a first cable, the connector splicing together said first cable to another conductor, wherein at least a portion of the electrically conductive pin cable extends through said insulated base to form an opposing prong for connection to said another conductor.

10. The connector according to claim 6, wherein at least one of the ends of the at least one electrically conductive arm having a shape selected from the group consisting of pointed, flat, rounded, and knurled.

11. The connector according to claim 6, wherein the cable has a conductive medium layer insulated from both the surrounding wire(s) and the center conductor, both said terminal segment(s) and said conductive arm(s) contacting said conductive medium layer to form said electrical contact between said arm(s) and said terminal segment(s).

* * * * *